US007182482B2

(12) United States Patent
Sinesi et al.

(10) Patent No.: US 7,182,482 B2
(45) Date of Patent: Feb. 27, 2007

(54) LIGHT DEVICE, PARTICULARLY A LIGHT PANEL FOR ROAD SIGNS OR INFORMATION TO THE PUBLIC, OR A MOTOR-VEHICLE LIGHT

(75) Inventors: Sabino Sinesi, Piossasco (IT); Gianluca Rotaris, Amaro (IT); Patrizia Melpignano, Amaro (IT); Michele Antonipieri, Amaro (IT); Silvia Priante, Amaro (IT)

(73) Assignee: Centro Ricerche Plast-Optical S.r.L., Amaro (IT)

( * ) Notice: Subject to any disclaimer, the term of this patent is extended or adjusted under 35 U.S.C. 154(b) by 168 days.

(21) Appl. No.: 10/953,532

(22) Filed: Sep. 30, 2004

(65) Prior Publication Data

US 2005/0094404 A1 May 5, 2005

(30) Foreign Application Priority Data

Oct. 30, 2003 (IT) ..... TO2003A0853

(51) Int. Cl.
*F21V 5/00* (2006.01)

(52) U.S. Cl. ..... 362/246; 362/339

(58) Field of Classification Search ..... 362/337, 362/322–334
See application file for complete search history.

(56) References Cited

U.S. PATENT DOCUMENTS

| | | | | |
|---|---|---|---|---|
| 5,633,629 | A * | 5/1997 | Hochstein | 340/907 |
| 5,819,454 | A | 10/1998 | Rosenitsch | |
| 5,833,355 | A * | 11/1998 | You et al. | 362/244 |
| 6,707,435 | B1 * | 3/2004 | Merlato et al. | 345/39 |
| 6,929,390 | B2 * | 8/2005 | Amano | 362/545 |

FOREIGN PATENT DOCUMENTS

JP 2002 183891 A 6/2002

* cited by examiner

*Primary Examiner*—Ali Alavi
(74) *Attorney, Agent, or Firm*—Sughrue Mion, PLLC

(57) ABSTRACT

A light device, for example in the form of a light panel for road signals or in the form of a motor-vehicle light, comprises an array of light sources, such as LEDs or the like. Associated to each light source is an optical system consisting of a refractive lens of a plane-convex type having a plane face facing the light source, in which a diffuser of a refractive or diffractive micro-optical type is incorporated.

14 Claims, 5 Drawing Sheets

LIGHT DEVICE, PARTICULARLY A LIGHT PANEL FOR ROAD SIGNS OR INFORMATION TO THE PUBLIC, OR A MOTOR-VEHICLE LIGHT

BACKGROUND OF THE INVENTION

The present invention relates to the field of light devices, in particular to light panels for road signs or information to the public, and to motor-vehicle lights.

SUMMARY OF THE INVENTION

The invention relates in particular to light devices of the type comprising: a panel bearing an array of light sources or array of clusters of light sources, for example consisting of LEDs; and optical means for controlling the light beam at output from said light sources. A light device of the type referred to above is, for example, described and illustrated in the U.S. Pat. No. 5,715,619, in which associated to each cluster of light sources are visor-shaped means for protecting the light sources from incident solar radiation from outside.

In actual fact, one of the major problems that are encountered in devices of this type derives from the fact that the device reflects an external light radiation (for example, sunlight or a light beam coming from the projectors of a motor vehicle), with consequent reduction of the ratio of luminance of the device and of the contrast between the device turned off and the device turned on. The ratio of luminance is defined as $$R=(L_a-L_b)/L_b$$

where $L_a$ is the luminance measured with the device turned on illuminated from outside, and $L_b$ is the luminance measured with the device turned off illuminated from outside.

The problem described above is accentuated in the case where an optical system for controlling the light beam at output is put in front of each light source. Said optical system tends in fact to behave as a lens or mirror also in regard to the radiation that comes from outside and tends to reflect said radiation, thus reducing the ratio of luminance defined above, as well as the contrast.

The purpose of the present invention is to solve said problem in a simple and effective way.

With a view to achieving this purpose, the subject of the invention is a light device having a panel bearing an array of light sources, or clusters of light sources, for example consisting of LEDs, and optical means for controlling the light beam at output from said light sources. Preferred embodiments of said device form the subject of the subsequent dependent claims.

BRIEF DESCRIPTION OF THE DRAWINGS

The invention will now be described with reference to the annexed drawings, which are provided purely by way of non-limiting example and in which.

DETAILED DESCRIPTION OF THE INVENTION

FIGS. 1 to 6 illustrate examples of optical systems that can be used in the device according to the invention. Each of said systems comprises a light source 1, for example consisting of an inorganic LED, and an optical system (i.e., a lens) 2 for controlling the radiation of the light source 1, which comprises a first face 2A facing the light source and a second face 2B facing the outside. Clusters of optical systems of the type illustrated, or individual optical systems, are envisaged for making the pixels of a light device, for example a light panel for road signs or information to the public, or a motor-vehicle light, according to the arrangement that is illustrated, for example, in FIG. 9. As likewise illustrated in FIG. 9, the light device comprises a supporting panel 3, on which there are mounted the light sources 1, as well as a supporting element 3A for the lenses 2.

Figure 1:
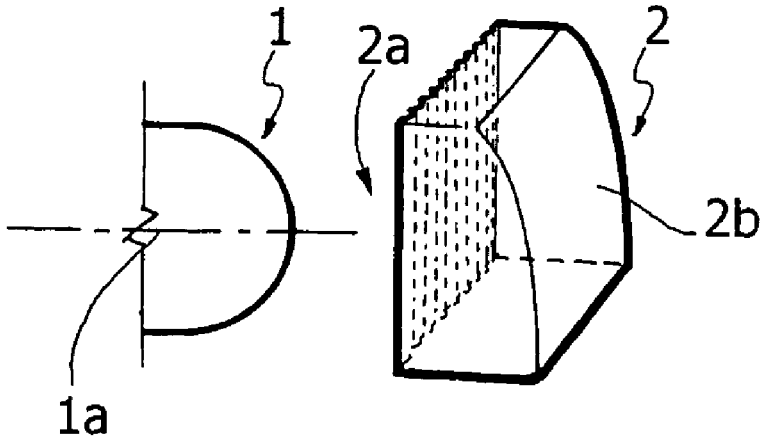
FIG. 1 is a schematic perspective view of a single optical system forming part of a first embodiment of the invention.
Figure 7:
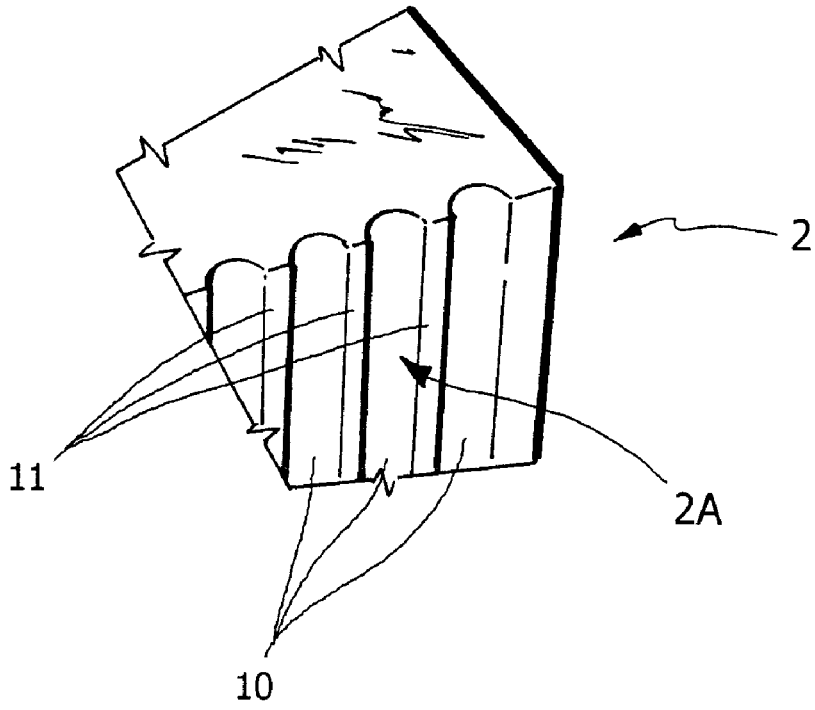
FIG. 7 is a perspective view, at an enlarged scale, of a detail of an element of the invention.

In the case of the first embodiment illustrated in FIG. 1, the optical system 2 consists of a refractive lens of a plane-convex type, in which the face 2A is a plane face, on which there is incorporated a diffuser, which may be of a refractive micro-optical type or a diffractive micro-optical type. For example, the face 2A can incorporate an array of cylindrical microlenses 10, of the type visible, at an enlarged scale, in FIG. 7. In the case of the example illustrated in said figure, the cylindrical microlenses 10 alternate with plane portions 11, which have the task of maintaining a higher peak in the central region of the lobe of emission of the device.

The effect of the diffuser on the face 2A is both that of rendering the beam at output from the light source 1 homogeneous and that of preventing the formation of a new virtual light source for re-focusing the solar radiation coming from outside and incident upon the lens 2.

For the purpose of directing the radiation of the light source 1 according to the required angular range, just part of the lens 2 is used, by displacing the light source 1 into a median position with respect to this portion of lens and thus obtaining an effect of lowering of the focal point with respect to the optical axis. In the case of the first embodiment illustrated in FIG. 1, the face 2A bearing the micro-optical system is perpendicular to the optical axis 1A of the diode. The outer face 2B has, instead, a curvature with a substantially constant radius of curvature.

Figure 2:
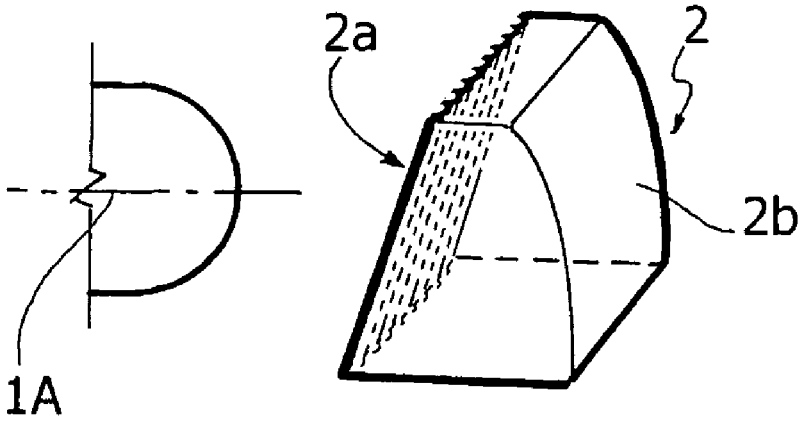
FIG. 2 illustrates a second embodiment of the invention.
Figure 3:
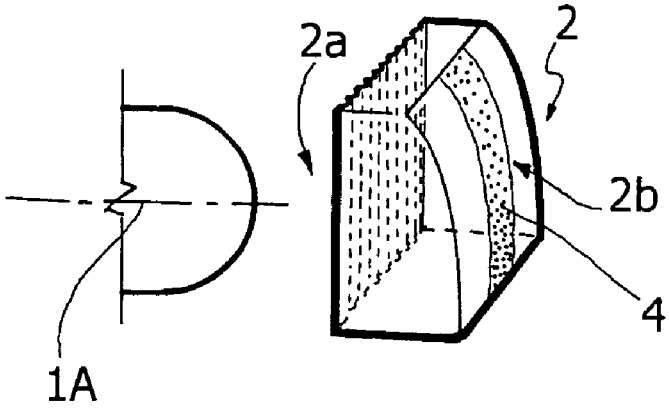
FIGS. 3, 4, 5 and 6 illustrate further embodiments of the invention.
Figure 4:
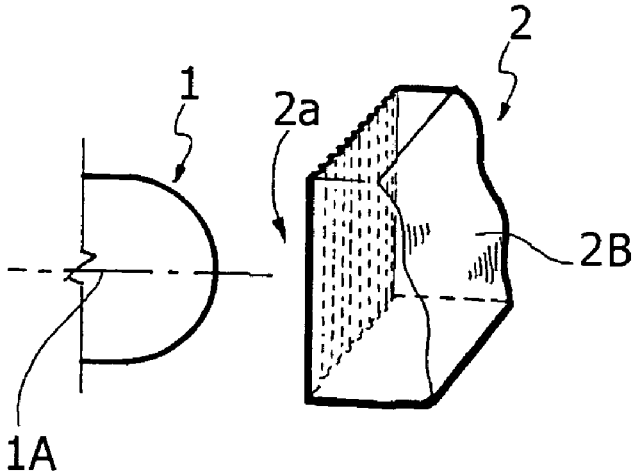

The second embodiment illustrated in FIG. 2 enables elimination of the effect of lowering of the focal point with respect to the optical axis, which was described above with reference to the solution of FIG. 1. In the case of the second embodiment, the face 2A bearing the micro-optical system is oblique with respect to the axis 1*a* of the diode. The solution thus differs from that of FIG. 1 in that a prism has been incorporated on the face 2A, by positioning the diffuser along the inclined plane of the prism.

A third embodiment (FIG. 3) is similar to that of FIG. 1, but differs therefrom in that, on the smooth convex surface of the face 2B of the lens 2, there is incorporated a diffusive strip 4. The effect of said strip is to diffuse further the solar radiation incident upon the convex surface and thus improve the ratio of luminance, so reducing the effect of the reflected solar radiation. Of course, the solution illustrated in FIG. 3 could also be adopted with reference to the configuration of FIG. 2 as regards to the inner face 2A.

A fourth solution (FIG. 4) differs from that of FIG. 1 in that the convex surface of the face 2B is not of a spherical type, but has a non-spherical shape, with a variable radius of curvature, which can be determined by means of calculation for the purpose of distributing the radiation of the light source in a pre-determined vertical angular range. In this case a prism effect will be obtained on account of the particular shape of the surface calculated, and hence it will not be necessary to adopt the solution of FIG. 2 to obtain the effect of axially aligned focusing, but a plane vertical surface will be sufficient for the face 2A. Also in this case, the plane part 2A will incorporate, of course, a refractive or diffractive micro-optical diffuser element.

Figure 5:
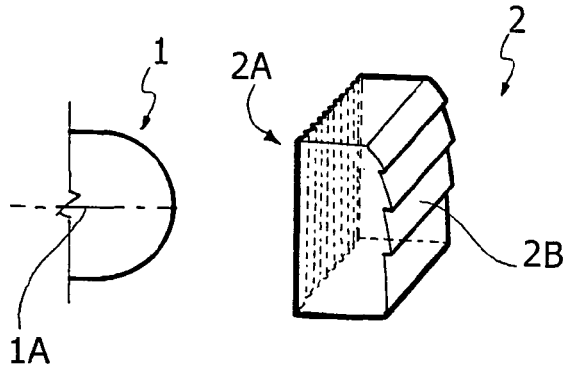

A further fifth variant consists of the replacement of the surface 2*b*, characterized by a continuous profile, with a Fresnel lens, having the same functional characteristics from the optical standpoint (focus, axis, etc.), but a discontinuous and flatter profile (see FIG. 5).

Figure 6:
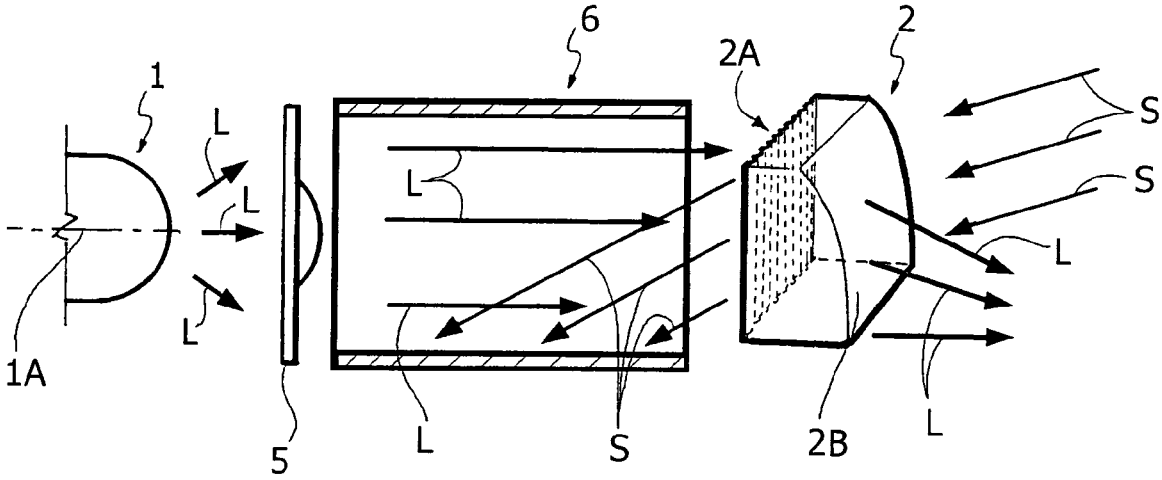

The sixth embodiment, illustrated in FIG. 6, consists of an optical system including a lens 5 for collimating the light emitted by the light source, and a tube or an equivalent distribution of diaphragms 6, typically black, having the function of absorbing the light radiation, the lens 2 being made according to any one of the solutions illustrated in FIGS. 1 to 5. In the case of FIG. 6, the external radiation is deviated by the lens 2 off axis on the wall of the absorbent element 6. The rays coming from the light source are designated by L and the ones due to the external solar radiation are designated by S. Thanks to said arrangement, the solar radiation that arrives on the light source and that is consequently reflected thereby is reduced or annulled. Furthermore, the micro-optical system is such as to prevent any back reflection of the solar radiation coming from outside and is at the same time designed not to modify the distribution of the light coming out in at least one plane, either the vertical plane or the horizontal plane.

Figure 8:
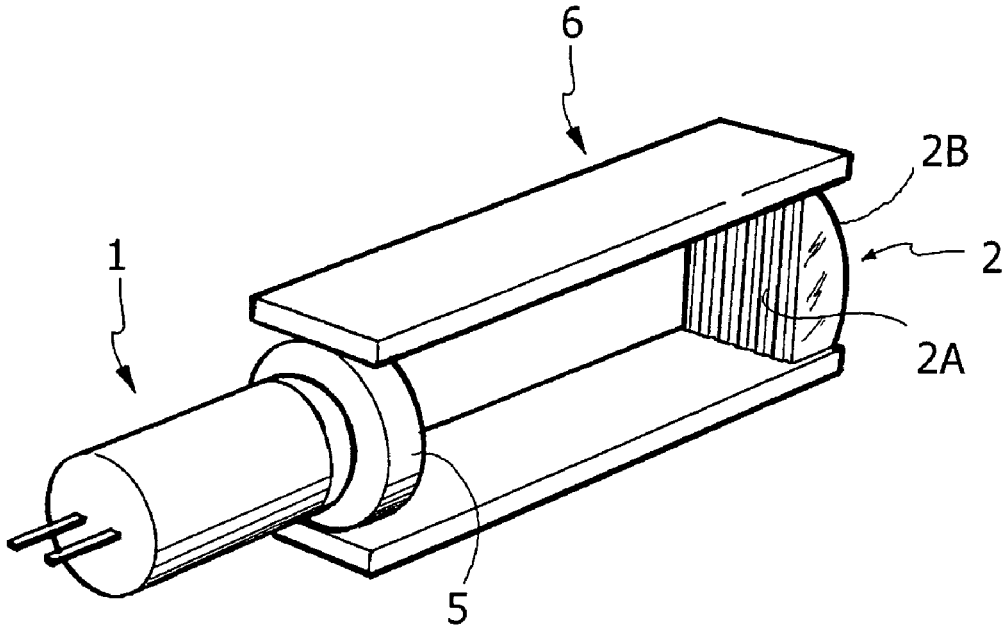
FIG. 8 illustrates a partial perspective view of the optical system of FIG. 6.
Figure 9:
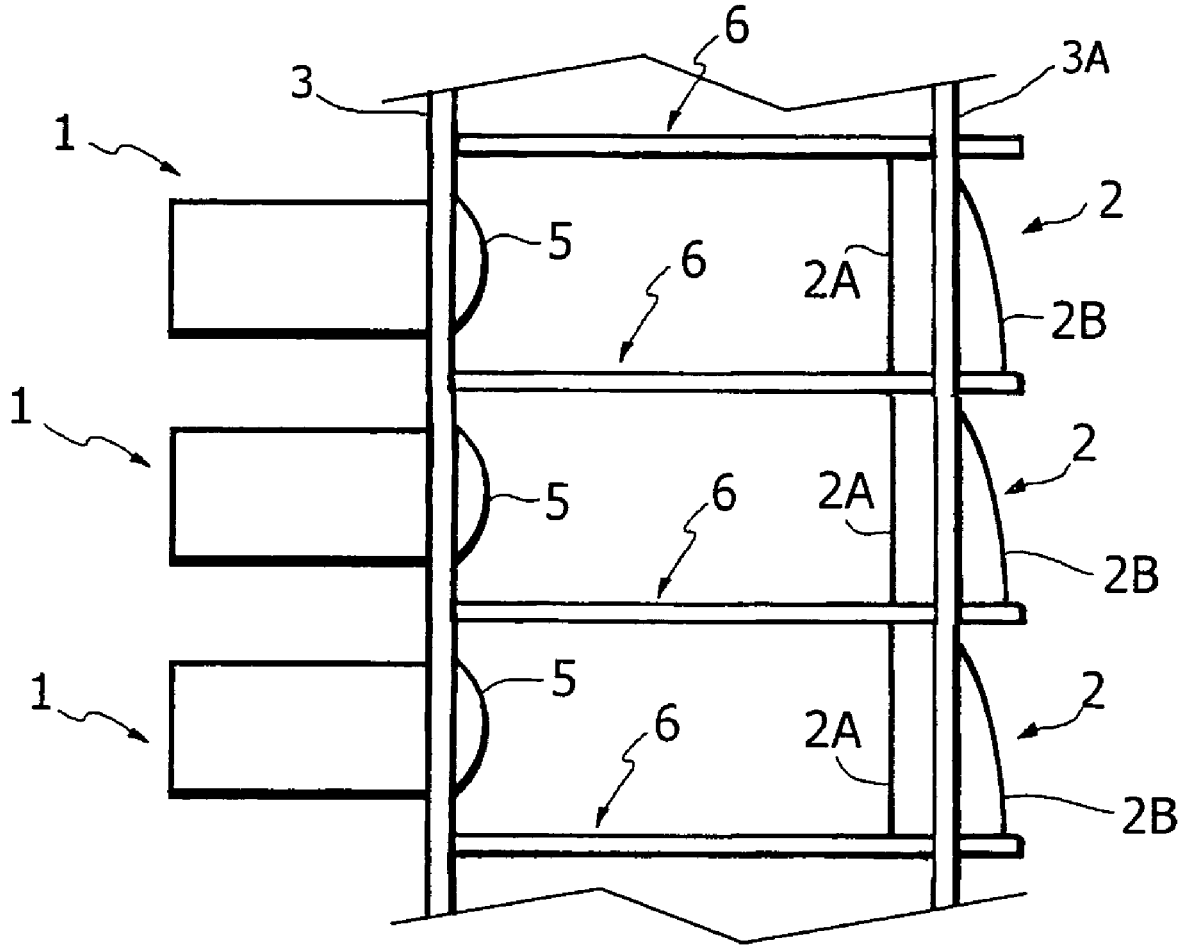
FIG. 9 is a partial cross-sectional view of a light panel incorporating a plurality of optical systems of the type illustrated in FIG. 6.

FIG. 9 shows a plurality of optical systems of the type illustrated in FIGS. 6 and 8, in a structure of a light panel for road signs or information to the public, or in a structure of a motor-vehicle light. In a concrete example, diodes having a diameter of 5 mm have been used as light sources 1, with lenses 2 having a height also of a few millimetres, for example, 6 mm.

Of course, without prejudice the principle of the invention, the details of construction and the embodiments may widely vary with respect to what described and illustrated herein purely by way of example, without thereby departing from the scope of the present invention.

What is claimed is:

1. A light device, comprising a panel bearing an array of light sources, or clusters of light sources, and an optical system for controlling the light beam at output from said light sources, wherein the optical system is set in front of each light source for controlling the radiation emitted by the light source, said optical system including an off-axis refractive lens or off-axis Fresnel lens having a first face, which is planar and is set facing the light source, and a second face, wherein said first face incorporates a diffuser of a refractive or diffractive micro-optical type, which covers at least part of the surface of said first face, and wherein set between the light source and the optical system is a system of diaphragms or a tubular element eqiuvalent thereto for absorption of the solar radiation that comes from outside and is transmitted by the optical system into said absorbent system.

2. The light device according to claim 1, wherein said diffuser of a micro-optical type consists of an array of micro-optical systems, for example an array of cylindrical microlenses.

3. The light device according to claim 2, wherein the diffuser of a micro-optical type consists of an array of cylindrical microlenses alternating with plane portions.

4. The light device according to claim 1, wherein the first plane face is oblique with respect to the optical axis of the light source.

5. The light device according to claim 1, wherein the surface of the second face incorporates a diffusive strip.

6. The light device according to claim 1, wherein the second face has a curved surface with a constant radius of curvature.

7. The light device according to claim 1, wherein the second face has a curved non-spherical surface.

8. The light device according to claim 1, wherein the second face has a segmented Fresnel surface with an off-axis section.

9. The light device according to claim 1, wherein the first plane face is substantially orthogonal to the optical axis of the light source.

10. The light device according to claim 1, wherein set between the light source and the optical system is a lens for collimating the light beam coming from the light source.

11. A light panel for road signals according to claim 1.

12. A light panel for information to the public according to claim 1.

13. A motor-vehicle light, according to claim 1.

14. A light device, comprising a panel bearing an array of light sources, or clusters of light sources, and an optical system for controlling the light beam at output from said light sources, wherein the optical system is set in front of each light source for controlling the radiation emitted by the light source, said optical system including an off-axis refractive lens or off-axis Fresnel lens having a first face, which is planar and is set facing the light source, and a second face, wherein said first face incorporates a diffuser of a refractive or diffractive micro-optical type, which covers at least part of the surface of said first face, and wherein said second face is curved.

* * * * *